US005930969A

United States Patent [19]

Mayle et al.

[11] Patent Number: 5,930,969

[45] Date of Patent: Aug. 3, 1999

[54] ROOF MEMBRANE ATTACHMENT SYSTEM

[76] Inventors: Robert L. Mayle, 2047 S. Hyde Rd., Port Clinton, Ohio 43452; Steven Mayle, 2274 Augusta Dr., Fremont, Ohio 43420

[21] Appl. No.: 08/920,622

[22] Filed: Aug. 27, 1997

Related U.S. Application Data

[60] Provisional application No. 60/035,293, Jan. 10, 1997, and provisional application No. 60/024,625, Aug. 27, 1996.

[51] Int. Cl.[6] ..... E04D 1/34

[52] U.S. Cl. ..... 52/545; 52/410; 52/549; 52/551; 52/552; 52/748.1

[58] Field of Search ..... 52/410, 512, 518, 52/545, 546, 549, 551, 553, 552, 748.1

[56] References Cited

U.S. PATENT DOCUMENTS

| | | | |
|---|---|---|---|
| 1,163,034 | 12/1915 | Phippen | 52/551 |
| 2,176,344 | 10/1939 | Hunt | 52/551 |
| 2,256,313 | 9/1941 | Dexter | 52/551 |
| 4,671,036 | 6/1987 | Sullivan . | |
| 4,718,211 | 1/1988 | Russell et al. | 52/409 |
| 4,726,164 | 2/1988 | Reinwall et al. | 52/410 |
| 4,860,514 | 8/1989 | Kelly . | |
| 5,197,252 | 3/1993 | Tiscareno | 52/553 |

*Primary Examiner*—Christopher T. Kent
*Assistant Examiner*—Yvonne Horton-Richardson
*Attorney, Agent, or Firm*—Standley & Gilcrest

[57] ABSTRACT

A method and apparatus for attaching roof membranes to roof decks. A bridge is placed on flaps created by overlapping portions of roofing material. The bridge is comprised of two end portions which engage the roofing material. A screw is preferably installed through the bridge and into the roof deck. When wind applies force to the roofing membrane, the bridge creates a fulcrum-like effect which helps secure the roof membrane to the roof deck.

7 Claims, 3 Drawing Sheets

ROOF MEMBRANE ATTACHMENT SYSTEM

This application claims the benefit of U.S. Provisional application Ser. No. 60/035,293 filed Jan. 10, 1997 and U.S. Provisional application Ser. No. 60/024,625 filed Aug. 27, 1996.

BACKGROUND AND SUMMARY OF THE INVENTION

This invention relates to a system of attaching a protective sheet roofing membrane on roof decks (or other substrates) which results in a substantial reduction in time and labor for installation, while achieving the desired result of securely attaching the membrane so that it remains securely attached when exposed to wind and other forces.

Known systems of installing a protective sheet roofing membrane require time consuming and labor intensive procedures and may result in a roofing membrane that is not securely attached to the roof deck. The system of the present invention for installing a protective roofing membrane involves creating a substantially continuous sheet of roof material by consecutively overlapping a few inches of individual protective roof material sheets at predetermined intervals. The sheets are welded, or otherwise seamed, together resulting in the underside of the continuous sheet having flaps (resulting from the overlap) of roofing material at every predetermined number of feet. In the field, at the time of installation, an aluminum (or other material) arched bridge (seal bar), preferably with one or more securing protrusions extending downward from its arched underside, is manually placed by the installer on the flap of roofing material between two sheets of the connected (welded) roofing material, preferably abutting the point of the weld. Thereafter a fastener, such as a wood screw, is driven through the top of the bar (bridge) at a location preferably close to the point of the weld, through the flap of roof material, preferably through a rigid layer of insulation and into the wood (or plywood, metal, concrete, tectum, gypsum or other material) roof deck. The continuous sheet of roof material is then rolled to the next location for screw insertion thus covering the last inserted screw.

The length and width of the sheet of roof membrane will vary based on the width or height of the roofing surface. The sheet of roof membrane can also be standardized to a no material waste standard size that a contractor can fit in the center of a roof, while making the appropriate fitting measurements at the perimeters of the roof. This process will standardize the sheets and cut material costs. Various known materials can be used to manufacture the sheet of roof membrane of the present invention.

In addition to the features mentioned above, objects and advantages of the present invention will be readily apparent upon a reading of the following description.

BRIEF DESCRIPTION OF THE DRAWING

Novel features and advantages of the present invention, in addition to those mentioned above, will become apparent to those skilled in the art from a reading of the following detailed description in conjunction with the accompanying drawings wherein similar reference characters refer to similar parts and in which.

DESCRIPTION OF THE PREFERRED EMBODIMENT

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
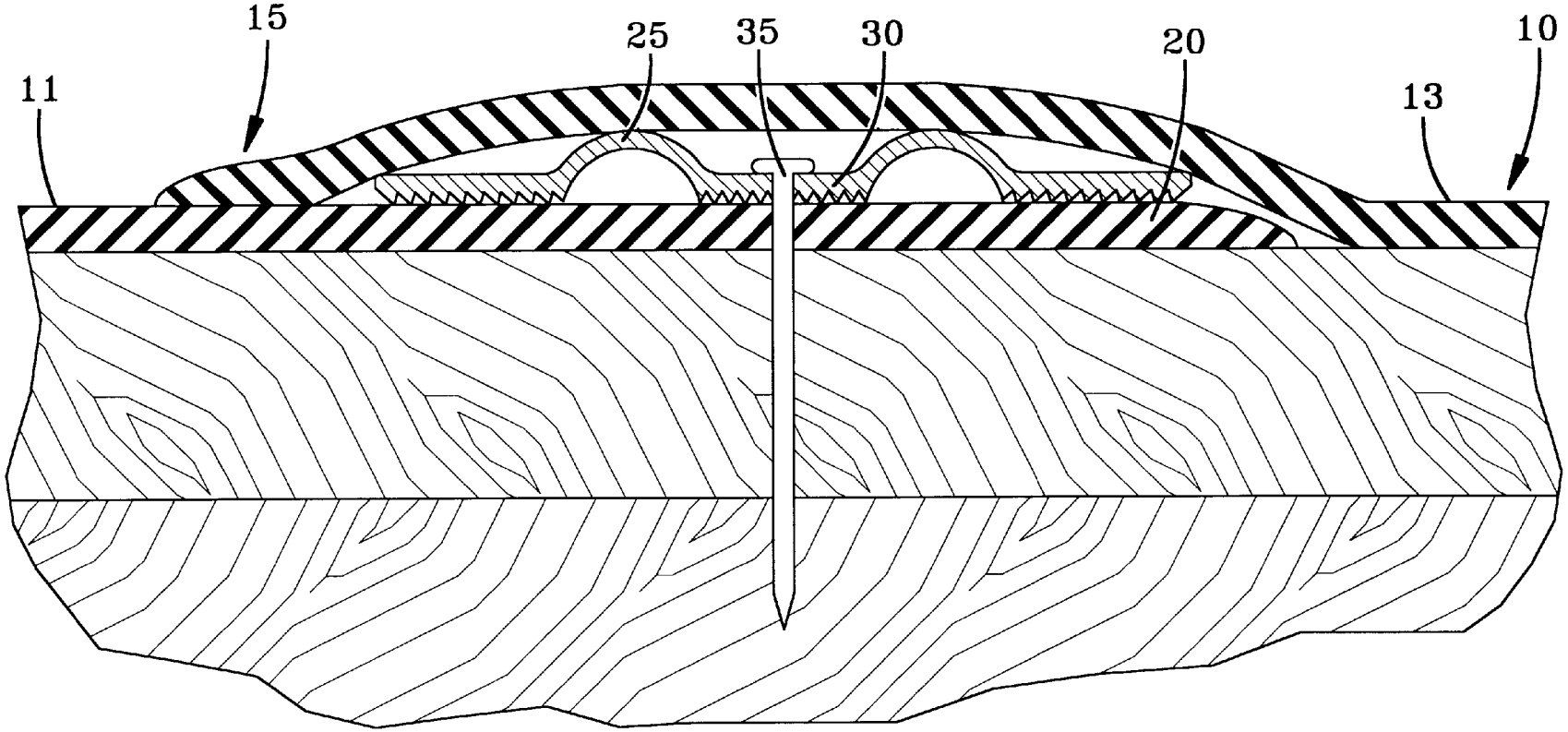
FIG. 1 is a cross-sectional view of the attaching system of the present invention.

FIG. 1 illustrates the attachment of roofing material on a roof deck using the system of the present invention. The system of installing protective roof material of the present invention may be accomplished with a pre-fabricated sheet of roof membrane 10 of the present invention. A pre-fabricated sheet of roof membrane 10 is preferably comprised of: overlapping consecutive sheets of protective roofing material by approximately 3–4 inches of overlap every span of 12 feet of material (these dimensions are offered for the purpose of an example of the present invention and are not intended to so limit the scope of the invention). The consecutive roof material sheets are welded or seamed together (shown at 15). This overlapping and welding results in approximately 3–4 inch roofing material flaps 20 at predetermined intervals on the underside of the newly created continuous sheet of roofing material. Once welding is complete, the material may be rolled up for easy transportation to the installation site. When installing, the material is rolled out in a first portion 11 to the first flap portion, and an arched bar (bridge) 25, with protrusions 30 extending downwardly from the arched bar (bridge) underside, is placed by the installer on the flap (or second portion) 20. A fastener 35 is then driven through the top portion of the arched bar (bridge). The roof material is un-rolled in a third portion 13 to the next point of screw insertion and this method continues until all installed screws are covered.

Installing the screws at 12 foot intervals as opposed to 6 foot intervals for example, is a time and labor saver. Former systems could not increase the distance between fasteners and still keep the roof material in place in heavy winds.

Due to the specified location of screw insertion through the arched bar (bridge) 25 and the protrusions 30 extending from the underside of the bar (bridge), when wind applies force to the surface of the protective roof material the fastener 35 may tend to pull up from the deck slightly causing the remainder of the bar (bridge) (the downwardly extending protrusions inclusive) to drive downward into the roof material preventing the screw from pulling out further. A fulcrum-like effect is created by the bar (bridge) and fastener.

Figure 2:
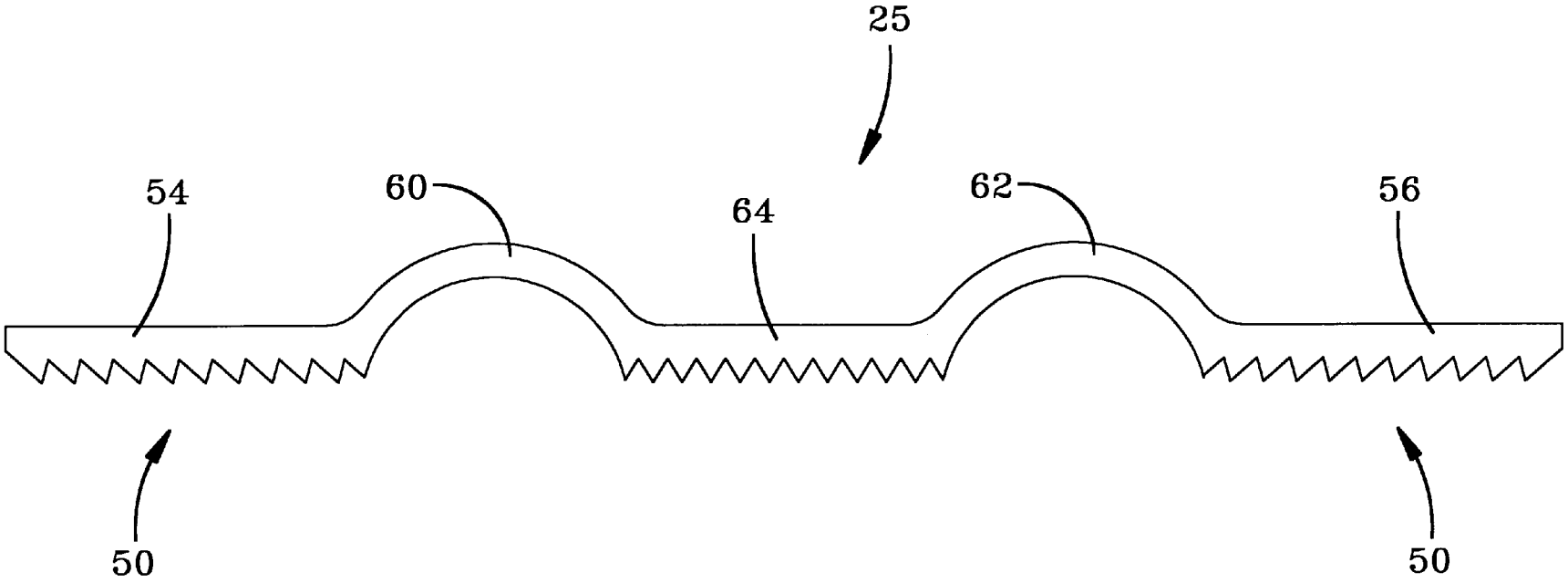
FIG. 2 illustrates a preferred embodiment of the bar of the present invention.

FIG. 2 illustrates a preferred embodiment of the bar 25 of the present invention. The teeth 50 (or jagged edges) located on the underside of the bar 25 act to grasp the roof. The bar 25 is preferably formed from an elongated piece of predetermined material, the elongated piece of predetermined material having a first end 54 and second end 56. The bar 25 is preferably 2.75 inches wide from first end 54 to second end 56. The bar 25 is preferably 10 feet long. It is also preferred that the first and second ends 54, 56 of the bridge 25 contain teeth 50 on its underside for grasping the roofing material 10. Note that in the preferred embodiment the teeth 50 at one end of the device are pitched at an angle, while the teeth 50 at the opposing end of the device are pitched at a similar angle in the reverse direction. In this manner, whether the roof membrane is moved in either direction it will engage the teeth at least one end of the device.

It is also preferred that the bar 25 contain a first and second arched portion 60, 62. To the extent any portion of the membrane continues to move in the direction of one end of the device, the membrane may gather in one of the arched portions 60, 62. The arched portions 60 and 62 also provide a recess to install a fastener 35 and provides additional structural strength to the bar 25. The bar 25 may be secured to the roof deck by means of a threaded screw, for example. The bar 25 may act as a fulcrum when force is applied, for example, to its first end 54 and when a screw is inserted through the bridge 25 and into the roofing material lying on the roof deck. Accordingly, the present invention allows the roofing material to be secured to the roof deck at longer intervals which reduces the labor and cost of securing roofing material. It is also preferred that the second arched portion 62 be spaced a predetermined distance from the first arched portion 60. An intervening bridge portion 64 separates the first and second arched portions 60, 62. It is also preferred that the intervening bridge portion 64 contain teeth 50 for grasping the roofing material 10.

Figure 3:
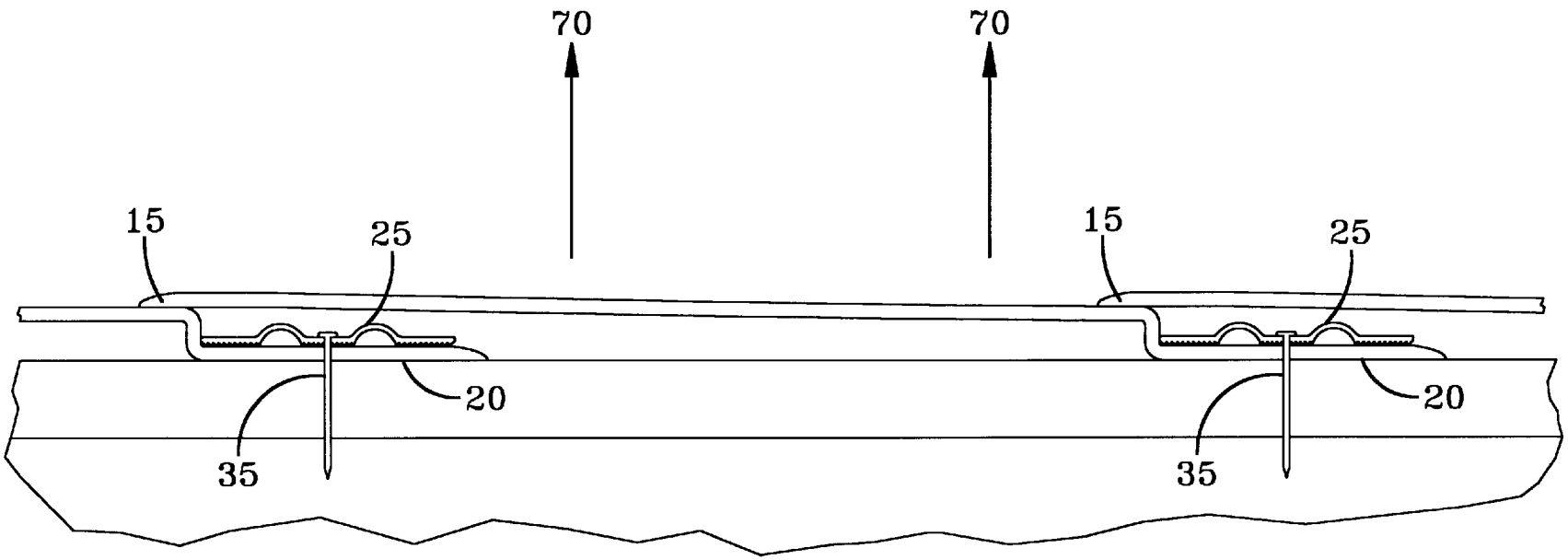
FIG. 3 illustrates a side view of a continuous sheet of roofing material attached with the bar of the present invention.

FIG. 3 illustrates a side view of a continuous sheet of roofing material 10 attached with the bar of the present invention. As illustrated, flaps 20 are preferably placed at predetermined points along the underside portion of the roofing material. The installed bars 25 secure the roofing material to the deck. As the wind blows, forces are created which elevate portions of the roofing material in the direction indicated by arrows at 70. The bars 25 help maintain the roofing material on the roof by insuring that the installed fasteners 35 will not be pulled out. As discussed, as the roofing material is elevated according to the arrows at 70, the teeth 50 of the bar 25 grasp the flap 20 portion and provides structural stability to the installed fasteners 35. The bars 25 insure that the fasteners 35 will not be pulled at angles from the force of the wind (Letting the fastener 35 be pulled out at angles increases the chance that the fasteners 35 will be pulled out. Keeping the fastener 35 completely vertical keeps the fastener 35 in a position where the threads of the fastener 35 will provide the greatest force against the external pulling forces).

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. An apparatus for attaching roofing material to a roof deck, comprised of:

an elongated piece of predetermined material, said elongated piece of predetermined material having a first and second end;

an intervening portion interposed between said first and second ends;

wherein said intervening portion is disposed off said roofing material when said first and second ends engage said roofing material;

wherein said apparatus is adapted to engage a fastener between its first and second end;

wherein said first and second ends contain downwardly extending protrusions for grasping said roofing material; and wherein said first and second ends are adapted to engage said roofing material and wherein said apparatus helps keep said roofing material attached to said roof deck against external forces.

2. An apparatus for attaching roofing material to a roof deck according to claim 1 wherein said elongated piece of predetermined material contains a first and second arched portion; and wherein said second arched portion is spaced a predetermined distance from said first arched portion; and wherein an intervening bridge portion separates said first and second arched portions.

3. An apparatus for attaching roofing material to a roof deck according to claim 2, wherein said intervening portion has holes for installing fasteners.

4. An apparatus for attaching roofing material to a roof deck according to claim 1 wherein said apparatus is approximately 2.75 inches wide.

5. An apparatus for attaching roofing material to a roof deck, comprised of:

an elongated piece of predetermined material, said elongated piece of predetermined material having a first and second end;

wherein said apparatus is adapted to engage a fastener between its first and second end;

wherein said elongated piece of predetermined material contains a first and second arched portion, wherein said second arched portion is spaced a predetermined distance from said first arched portion, wherein said arched portions are disposed off said roofing material when said first and second ends engage said underlying roofing material;

wherein an intervening bridge portion separates said first and second arched portions;

wherein said intervening bridge portion contains downwardly extending protrusions for grasping said roofing material; and wherein said first and second ends are adapted with downwardly extending protrusions for engaging said underlying roofing material and wherein said apparatus helps keep said roofing material attached to said roof deck against external forces.

6. An apparatus according to claim 5 wherein said downwardly extending protrusions of said first and second ends are teeth pitched inwardly at an angle to grasp said roofing material.

7. An apparatus according to claim 6, wherein said teeth on both said first and second ends drive down into said roofing material to secure said roofing material to said roof against external forces.

* * * * *